US005094395A

United States Patent [19]

Lambert

[11] Patent Number: 5,094,395

[45] **Date of Patent: * Mar. 10, 1992**

[54] APPARATUS AND METHOD FOR DISPENSING PLASTIC STRETCH FILM

[75] Inventor: James V. C. Lambert, Webster, N.Y.

[73] Assignee: Mobil Oil Corporation, Fairfax, Va.

[ * ] Notice: The portion of the term of this patent subsequent to Feb. 5, 2008 has been disclaimed.

[21] Appl. No.: 210,176

[22] Filed: Jun. 20, 1988

Related U.S. Application Data

[63] Continuation of Ser. No. 940,681, Dec. 11, 1986, abandoned.

[51] Int. Cl.[5] ..... B65H 23/06

[52] U.S. Cl. ..... 242/96; 242/99

[58] Field of Search ..... 242/96, 99, 156, 156.2, 242/75.4, 55.2, 55.54, 129.8, 129.51, 68, 68.3, 68.4; 53/390, 556, 587; 156/574, 577, 579

[56] References Cited

U.S. PATENT DOCUMENTS

| | | | |
|---|---|---|---|
| 1,348,079 | 7/1920 | Bir | 242/96 |
| 3,944,148 | 3/1976 | Freeman et al. | 242/75.4 X |
| 3,950,214 | 4/1976 | Pool | 156/577 X |
| 4,102,513 | 7/1978 | Guard | 242/75.4 |
| 4,166,589 | 9/1979 | Hoover | 242/75.4 |
| 4,179,081 | 12/1979 | Parry | 242/99 |
| 4,248,392 | 2/1981 | Parry | 242/96 |
| 4,369,614 | 1/1983 | Tetzner | 53/390 X |
| 4,477,037 | 10/1984 | Goldstein | 242/96 |
| 4,484,717 | 11/1984 | Goldstein | 242/96 |
| 4,530,473 | 7/1985 | Parry | 242/96 |
| 4,535,951 | 8/1985 | Riemenschneider, III | 242/96 |
| 4,575,020 | 3/1986 | Strout et al. | 242/96 |
| 4,600,163 | 7/1986 | Hummel et al. | 242/96 |
| 4,630,786 | 12/1986 | Lambert et al. | 242/96 |

FOREIGN PATENT DOCUMENTS

| | | | |
|---|---|---|---|
| 2717728 | 10/1978 | Fed. Rep. of Germany | 242/96 |
| 2065070 | 6/1981 | United Kingdom . | |
| 1604345 | 12/1981 | United Kingdom . | |
| 2115783 | 2/1982 | United Kingdom . | |
| 2109772 | 6/1983 | United Kingdom | 242/96 |
| 2121001 | 12/1983 | United Kingdom | 242/96 |

OTHER PUBLICATIONS

"Goodwrappers", 1 page.

*Primary Examiner*—John M. Jillions
*Attorney, Agent, or Firm*—A. J. McKillop; C. J. Speciale; J. P. O'Sullivan

[57] ABSTRACT

An apparatus and process for stretch-dispensing stretch wrap film is disclosed wherein a hollow core supply roll of stretch film is dispensed in a controlled manner utilizing a brake means mounted within the core which urges by its own resiliency against the inside surface of the core while still permitting frictionally retarded axially rotation of the core about the brake and having handles connected to this brake means.

9 Claims, 1 Drawing Sheet

FIG. 1
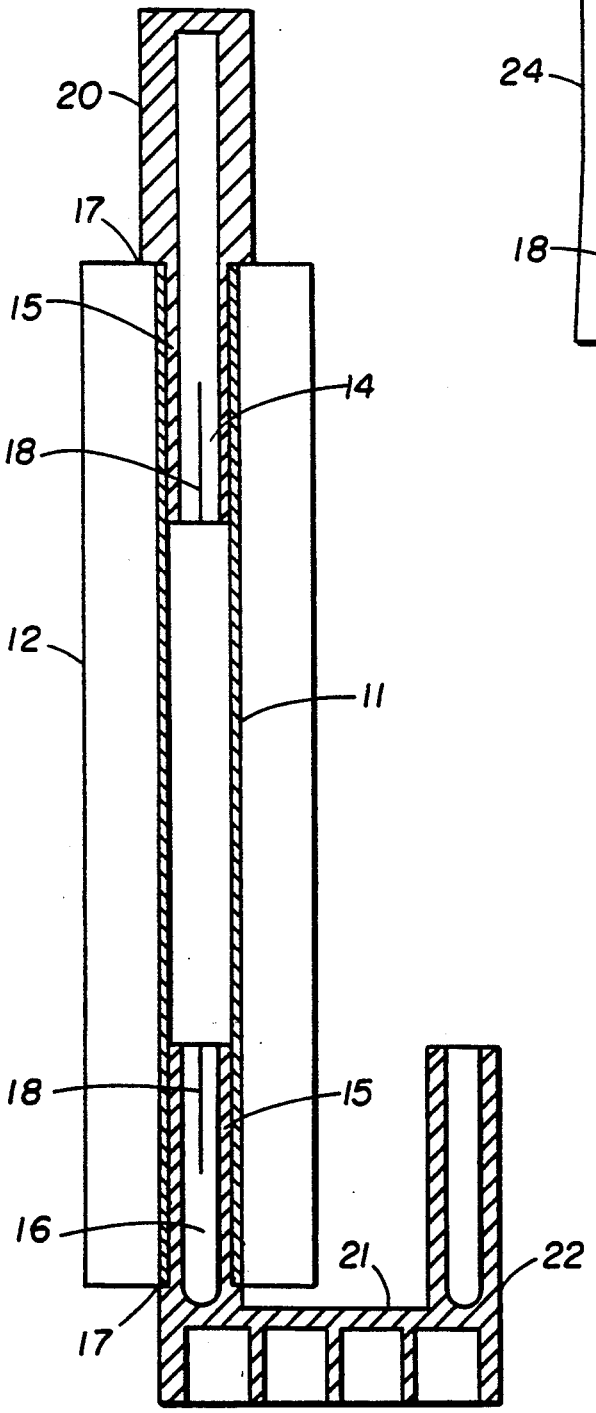
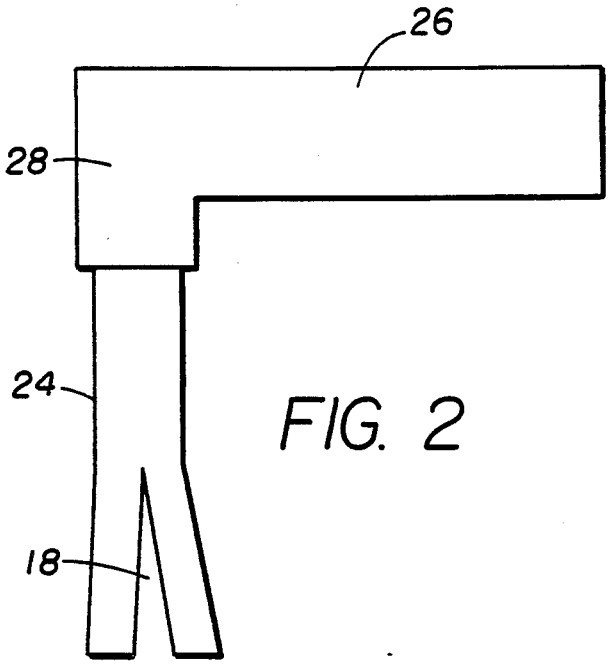
FIG. 2

APPARATUS AND METHOD FOR DISPENSING PLASTIC STRETCH FILM

This is a continuation of copending application Ser. No. 940,681, filed on Dec. 11, 1986, now abandoned.

This invention relates to a plastic stretch wrap film supply roll and dispensing control combination for manual application of such a film.

The invention disclosed in U.S. Pat. No. 4,630,786 employs a supply roll of stretch wrap film which has a first handle which is fixed to and rotates with the core of the roll. Therefore, with a roll that is 5, 10 or 20 inches in film width there is, for example, a 5 inch long handle fixed to the core of the roll. This fixed handle is present to accommodate a flexible handgrip which covers it, permitting the first handle to slideably rotate within the handgrip. Pressure on the handgrip can controllably impede the rotation of the handle and therefore the roll. While such a braking system does effectively control the stretch payout of such a film, it does so at the expense of certain disadvantages. The easiest way to provide a handle which is fixed to the core is to merely have the core extend, for example, some 5 inches beyond the width of the film. This technique of providing the handle or handles to the roll adds anywhere from 50 percent to 200 percent and more to the packaging volume of film rolls provided in this fashion. Thus, from the standpoint of volumetric efficiency, providing film rolls in this form leaves something to be desired. Solving this problem by providing an insertable handle which is fixed immovably within the core is too expensive a solution to the problem. The tolerances and complexity involved in after-inserting a completely fixed handle is not a practical solution to the problem.

It would be a significant advance in the art if the volumetric efficiency involved in shipping such rolls can be improved while at the same time providing the customer with an effective dispensing system adapted to utilize the stretch film in the most economical and effective manner.

SUMMARY OF THE INVENTION

The invention resides in an apparatus for the manual application of plastic stretch wrap film comprising in combination:

(a) a supply roll of plastic stretch wrap film convolutely wound onto a hollow core having an axial centerline, the width of said film being at least generally coextensive with the length of said core;

(b) at least one brake means comprising a resilient member, having a centerline coincident with said centerline of said core, mounted within said core so as to urge by its own resiliency against the inside surface of said core while permitting frictionally retarded axial rotation of said core about said brake; and (c) handle means connected to said brake means.

In a preferred form of the invention a pair of the defined brake means is mounted at opposite end regions of the roll core. It is further preferred that at least one handle, with its connection to the brake means, forms a U-shape, so that the handle is generally parallel to the centerline of the brake means. It is also contemplated that at least one handle be connected to the brake means through an angle. It is still further contemplated that at least one handle have an axial centerline coincident with the centerline of the brake means and the core. As will be seen, an arrangement having the most practicality within the scope of the invention employs either a U-shaped or L-shaped handle at one end and a straight or in-line handle at the other end of the supply roll.

The invention also involves a method for controlling the manual stretch dispensing of plastic stretch wrap film employing the above described apparatus comprising:

(a) anchoring the payout end of the film from the supply roll;

(b) manually holding the handles and exerting a stretching force on said film in a direction away from the point of anchoring; and (c) increasing the film stretching force to overcome the braking force of said brake means thereby stretch dispensing the film. Utilizing this technique a collection of items can be bundled or stabilized by spirally wrapping the collection with the stretch wrap film. The apparatus is ideally suited for manually supplementing the braking action on the supply roll by having the operator produce an additional drag on the supply roll in order to provide full and adequate control over the stretch of the film during application to the work pieces being stabilized. One example of applying this additional braking action is by pressing a thumb against the unwinding supply roll.

BRIEF DESCRIPTION OF THE DRAWING

FIG. 1 is a sectional view of a plastic stretch film supply roll and dispenser control members with handles.

FIG. 2 is a sideview of an alternative control member having a handle at 90° to the brake means.

DESCRIPTION OF THE PREFERRED EMBODIMENTS

Referring to the drawing, the apparatus includes a hollow core 11 about which is convolutely wound a roll supply of plastic stretch film 12. The length of the core 11 is coextensive with the width of the stretch film 12.

Mounted within the end regions of core 11 are brake means 14 and 16. These brake means are generally the same in structure and function but differ in the relative position of their respective handles 20 and 22.

The braking means 14 and 16 are formed from a hollow cylinder, molded of some suitable thermoplastic material, for example, polyethylene. The outside diameter of this hollow cylinder 15 closely approximates the inside diameter of core 11 so that there is contact between the 2 members. The dimension of the hollow tube 15 should not be so great as to prevent the core and supply roll from rotating about the hollow tube, all-be-it with some frictional resistance. In other words the fit plus the braking force will permit a resistance to rotation but not a prevention of rotation.

Formed some distance from the end of tube 15 and extending in the direction of the tube ends are axially extending slots 18. With such slots formed in the free ends of the tubes, the structure will be of increasing external diameter as compared to the internal diameter of the core. The slotted tube is formed so that the increased external diameter near the end of the brake must be decreased before the brake can be inserted within the core. This is accomplished by manually squeezing the end of the braking device to close the slot thereby permitting insertion of the brake fully within the core. The natural resiliency of the end of the structure tending to open the slot provides the desired braking force on the inside of the core. Stop regions or shoulders 17 prevent the brake means from being inserted too far within the core member.

Handle 20 is simply a molded extension of brake means 14 and is obviously connected to brake means 14. Handle 22 is, like handle 20 a molded cylinder functioning as a handgrip. Handle 22 is connected to brake means 16 by way of molded connecting member 21. This handle and brake combination will be seen to have a generally U-shaped configuration which permits an operator to wrap pallets, and the like, close to the floor without interference as would be the case with an axially extending handle.

FIG. 2 shows an optional or alternative form of handle and brake combination which can be employed in either end of the core. This structure also is formed with a hollow cylinder brake means 24 of the same type described above but is shown with the slot 18 expanded as it would be outside of the supply roll core. The handle 26 can conveniently be a molded extension of the structure. The brake is connected to neck 28 to which the handle extends generally at a right angle. The brake is mounted within the core in the same manner by closing gap 18 and inserting it within the core. It will be understood that the handle can be of any convenient configuration facilitating stretch application of the stretch wrap film. Thus, it can be axially aligned with the brake member as shown at the upper region of FIG. 1. It also can be offset so as to be parallel to braking means 16 and connected thereto by some suitable connection so as to form a U-shaped member as in the lower region of FIG. 1. In addition, the handle can be connected with the braking means through any angle, such as, a 90 degree angle, as shown in FIG. 2.

In operation, the operator will take one end of the stretch wrap film and anchor it somewhere under one or more packages to be wrapped and stabilized, for example, on a conventional pallet. The particular stretch wrap film employed is not important. This material is well known in the art and is generally formed so as to include a polyethylene resin. It is produced in film form by techniques known to the art, which will permit the film to be stretched anywhere from 40 to 200 or more percent during the use thereof. This type of film usually has a characteristic which permits it to cling to itself in its stretched state. After the end of the film is anchored to the load, the operator places one hand on handle 20 and the other hand on handle 22 and exerts a stretching force in a direction opposite to the anchor point. Thereafter the operator continues this stretching force until it overcomes the force of the braking means within the core. The described braking means permit frictionally retarded axial rotation of the core about the brake. The force applied by the operator will overcome this friction and in so doing will stretch the film and permit payout of the stretched film from the supply roll.

The described brake-handle system is ideally suited to be manually brake-assisted by the operator during the wrapping operation. For example, with the operator's hand located about handle 20 his thumb is ideally located so as to apply a controlled drag on the periphery of the supply roll, thereby controlling more or less stretch depending upon the drag pressure applied. Similarly, with the operator's hand on handle 22 the back of the fingers of the operator are located so as to produce a drag on the periphery of the supply roll so as also to assist in controlling the stretch and payout of the film.

It will be appreciated that by virtue of the present invention a much more compact stretch film roll and control brake means and handles can be shipped to customers without having significant wasted shipping space. The supply rolls are shipped with the brake means and handles removed from the core and located somewhere between a cluster of rolls. Thus the package need not be any larger than the length of the supply roll.

While a particular example of the internal brake means has been described, it is to be understood that it can have other equivalent forms so long as the structure will urge by its own resiliency against the inside surface of the core while still permitting frictionally retarded axial rotation of the core about the brake.

I claim:

1. A plastic stretch wrap film supply roll and dispensing control combination for manual application of said film comprising:

(a) a supply roll of plastic stretch wrap film convolutely wound onto a hollow core having an axial centerline, the width of said film being at least generally coextensive with the length of said core;

(b) at least one brake means comprising a resilient member, having a centerline coincident with said centerline of said core, mounted within said core so as to urge by its own resiliency against the inside surface of said core while permitting frictionally retarded axial rotation of said core about said brake; and (c) handle means connected to said brake means.

2. The combination of claim 1 having a pair of said brake means mounted in opposite ends of said core.

3. The combination of claim 2 wherein at least one handle with its connection to said brake means forms a U-shape with the handle generally parallel to said brake means.

4. The combination of claim 2 wherein at least one handle is connected to said brake means thru an angle.

5. The combination of claim 2 wherein at least one handle has an axial centerline coincident with said centerline of said brake means and core.

6. The combination of claim 2 wherein one handle has an axial centerline coincident with said centerline of said brake means and core and the other handle with its connection to said brake means forms a U-shape.

7. The combination of claim 1 wherein said brake means is a hollow cylinder having axial slots extending along part of the length of the cylinder and having cylinder segments between slots which resiliently outwardly flare to an extent greater than the diameter of said cylinder.

8. The method of controlling the manual stretch dispensing of plastic stretch wrap film employing a supply roll an dispensing control combination comprising:

(a) a supply roll of plastic stretch wrap film convolutely wound onto a hollow core having an axial center line, with the width of said film being at least generally coextensive with the length of said core;

(b) at least one braking means comprising a resilient member, having a center line coincident with said center line of said core, mounted within said core so as to urge, by its own resiliency, against the inside surface of said core, while permitting frictionally retarded axial rotation of said core about said braking means; and, (c) handle means connected to said braking means; said method comprising:

(a) anchoring the payout end of said stretch wrap film;

(b) manually holding said handle means and exerting a stretching force on said film in a direction away from the point of anchoring; and (c) increasing the film stretching force to overcome the braking force of said braking means; thereby, stretch dispensing said film.

9. The method of claim 8 including manually supplementing the braking action on said supply roll by applying a dragging force on the periphery of said roll to further control the stretch dispensing of said film.

* * * * *